US008867795B2

(12) United States Patent
Yamada

(10) Patent No.: US 8,867,795 B2
(45) Date of Patent: Oct. 21, 2014

(54) APPARATUS AND NON-TRANSITORY COMPUTER-READABLE MEDIUM

(71) Applicant: Kenji Yamada, Nagoya (JP)

(72) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 95 days.

(21) Appl. No.: 13/784,103

(22) Filed: Mar. 4, 2013

(65) Prior Publication Data

US 2013/0243262 A1 Sep. 19, 2013

(30) Foreign Application Priority Data

Mar. 16, 2012 (JP) ..... 2012-059568

(51) Int. Cl.
*G06K 9/00* (2006.01)
*D05C 5/02* (2006.01)
*D05B 21/00* (2006.01)

(52) U.S. Cl.
CPC ..... *D05C 5/02* (2013.01)
USPC ..... 382/111; 382/274; 112/102.5

(58) Field of Classification Search
USPC ..... 382/100, 106, 103, 108, 111, 123, 162, 382/168, 173, 181, 194, 199, 232, 254, 274, 382/276, 286, 298, 305, 312; 112/470.04, 112/102.5; 700/138; 345/442
See application file for complete search history.

(56) References Cited

U.S. PATENT DOCUMENTS

2002/0038162 A1* 3/2002 Yamada ..... 700/138
2007/0233309 A1* 10/2007 Yamada ..... 700/138
2008/0289553 A1* 11/2008 Yamada ..... 112/470.04
2008/0297514 A1* 12/2008 Pedersen et al. ..... 345/442
2009/0217850 A1* 9/2009 Tokura ..... 112/102.5

FOREIGN PATENT DOCUMENTS

JP A-2001-259268 9/2001
JP A-2007-275105 10/2007
JP A-2008-289517 12/2008

* cited by examiner

*Primary Examiner* — Seyed Azarian
(74) *Attorney, Agent, or Firm* — Oliff PLC

(57) ABSTRACT

An apparatus includes a processor and a memory configured to store computer-readable instructions that, when executed, cause the apparatus to perform steps comprising calculating a first angle characteristic and an intensity of the first angle characteristic with respect to each of pixels, arranging a first line segment in a position corresponding to a first pixel based on the first angle characteristic, calculating a second angle characteristic of a second pixel based on the first angle characteristic of at least one pixel adjacent to the second pixel, acquiring information indicating a third angle characteristic, calculating a fourth angle characteristic based on the second angle characteristic and on the third angle characteristic, arranging a second line segment in a position corresponding to the second pixel based on the calculated fourth angle characteristic, and creating data indicating at least stitches that respectively correspond to the first line segment and the second line segment.

6 Claims, 14 Drawing Sheets

FIG. 8

| | | | | | | | | | |
|---|---|---|---|---|---|---|---|---|---|
| 51 | 45 | 37 | 27 | 14 | 0 | 166 | 153 | 143 | 135 |
| 59 | 53 | 45 | 34 | 18 | 0 | 162 | 146 | 135 | 127 |
| 68 | 63 | 56 | 45 | 27 | 0 | 153 | 135 | 124 | 117 |
| 79 | 76 | 72 | 63 | 45 | 0 | 135 | 117 | 108 | 104 |
| 90 | 90 | 90 | 90 | 90 | 0 | 90 | 90 | 90 | 90 |
| 101 | 104 | 108 | 117 | 135 | 0 | 45 | 63 | 72 | 76 |
| 112 | 117 | 124 | 135 | 153 | 0 | 27 | 45 | 56 | 63 |
| 121 | 127 | 135 | 146 | 162 | 0 | 18 | 34 | 45 | 53 |
| 129 | 135 | 143 | 153 | 166 | 0 | 14 | 27 | 37 | 45 |
| 135 | 141 | 149 | 158 | 169 | 0 | 11 | 22 | 31 | 39 |

APPARATUS AND NON-TRANSITORY COMPUTER-READABLE MEDIUM

CROSS-REFERENCE TO RELATED APPLICATION

This application claims priority to Japanese Patent Application No. 2012-059568, filed Mar. 16, 2012, the content of which is hereby incorporated herein by reference in its entirety.

BACKGROUND

The present disclosure relates to an apparatus that is capable of creating embroidery data used to sew an embroidery pattern by a sewing machine, and to a non-transitory computer-readable storage medium storing computer-readable instructions that cause an apparatus to create such embroidery data.

An apparatus is known that is capable of creating embroidery data for embroidering a design based on image data of an image, such as a photograph or the like, using a sewing machine that is capable of embroidery sewing. Based on image data acquired from an image that is read by, for example, an image scanner, a CPU of the known apparatus calculates an angle characteristic and an intensity of the angle characteristic (hereinafter referred to as an angle characteristic intensity) of each of sections in the image. The CPU arranges line segments in accordance with the calculated angle characteristics and angle characteristic intensities. The angle characteristic is information that indicates a direction in which continuity of a color is high. The angle characteristic intensity is information that indicates a magnitude of a color change. After that, the CPU determines a color of each of the line segments and connects the line segments of the same color. The CPU creates the embroidery data by converting data that indicates the connected line segments into data that indicates stitches.

SUMMARY

In the above-described apparatus, in order to effectively reflect the characteristics of the entire image, the CPU arranges line segments, giving priority to an angle characteristic with a strong intensity. On the other hand, in a section where the angle characteristic intensity is weak, the CPU arranges the line segments using a method that in which angle characteristics of surrounding pixels are taken into account or a method in which the angle characteristics are limited to a fixed direction. With the method in which the angle characteristics of the surrounding pixels are taken into account, it is possible to effectively express the features of the original image. However, there may be cases in which a unique embroidered texture cannot be produced. Further, with the method in which the angle characteristics are limited to the fixed direction, there may be cases in which stitches in the fixed direction, which are formed in a section where the angle characteristic is weak, stand out excessively.

Various embodiments of the broad principles derived herein provide an apparatus that is capable of creating embroidery data for forming stitches that naturally add a unique embroidered texture while effectively expressing features of an original image, and a non-transitory computer-readable medium storing computer-readable instructions that cause an apparatus to create such embroidery data.

Various embodiments provide an apparatus that includes a processor and a memory configured to store computer-readable instructions. The computer-readable instructions cause, when executed by the processor, the apparatus to perform steps that include calculating, based on image data of an image that is an aggregation of a plurality of pixels, a first angle characteristic and an intensity of the first angle characteristic with respect to each of the plurality of pixels, wherein the first angle characteristic is information indicating a direction in which continuity of a color in the image is high, and the intensity is information indicating a magnitude of change of the color, arranging a first line segment in a position that corresponds to a first pixel based on the calculated first angle characteristic, wherein the first pixel is a pixel whose calculated intensity is equal to or more than a threshold value, among the plurality of pixels, calculating a second angle characteristic of a second pixel based on the first angle characteristic of at least one pixel adjacent to the second pixel, wherein the second pixel is a pixel whose calculated intensity is smaller than the threshold value, among the plurality of pixels, acquiring information indicating a third angle characteristic, wherein the third angle characteristic is an angle characteristic set in advance, calculating a fourth angle characteristic based on the calculated second angle characteristic and on the third angle characteristic indicated by the acquired information, arranging a second line segment in a position that corresponds to the second pixel based on the calculated fourth angle characteristic, and creating, as embroidery data, data indicating at least stitches that respectively correspond to the arranged first line segment and the arranged second line segment.

Various embodiments also provide a non-transitory computer-readable medium storing computer-readable instructions. The computer-readable instructions cause, when executed by a processor of an apparatus, the apparatus to perform steps that include calculating, based on image data of an image that is an aggregation of a plurality of pixels, a first angle characteristic and an intensity of the first angle characteristic with respect to each of the plurality of pixels, wherein the first angle characteristic is information indicating a direction in which continuity of a color in the image is high, and the intensity is information indicating a magnitude of change of the color, arranging a first line segment in a position that corresponds to a first pixel based on the calculated first angle characteristic, wherein the first pixel is a pixel whose calculated intensity is equal to or more than a threshold value, among the plurality of pixels, calculating a second angle characteristic of a second pixel based on the first angle characteristic of at least one pixel adjacent to the second pixel, wherein the second pixel is a pixel whose calculated intensity is smaller than the threshold value, among the plurality of pixels, acquiring information indicating a third angle characteristic, wherein the third angle characteristic is an angle characteristic set in advance, calculating a fourth angle characteristic based on the calculated second angle characteristic and on the third angle characteristic indicated by the acquired information, arranging a second line segment in a position that corresponds to the second pixel based on the calculated fourth angle characteristic, and creating, as embroidery data, data indicating at least stitches that respectively correspond to the arranged first line segment and the arranged second line segment.

BRIEF DESCRIPTION OF THE DRAWINGS

Embodiments will be described below in detail with reference to the accompanying drawings in which:

FIG. 8 is an explanatory diagram of a matrix that corresponds to the concentric circular stitching pattern;

DETAILED DESCRIPTION

Hereinafter, an embodiment will be explained with reference to the drawings. First, a configuration of an embroidery data creation apparatus 1 will be explained with reference to FIG. 1. The embroidery data creation apparatus 1 is an apparatus that is capable of creating embroidery data to be used to sew an embroidery pattern by a sewing machine 3 (refer to FIG. 2) that will be described later. The embroidery data creation apparatus 1 of the present embodiment is capable of creating embroidery data for embroidering a design based on an image, such as a photograph or the like.

Figure 1:
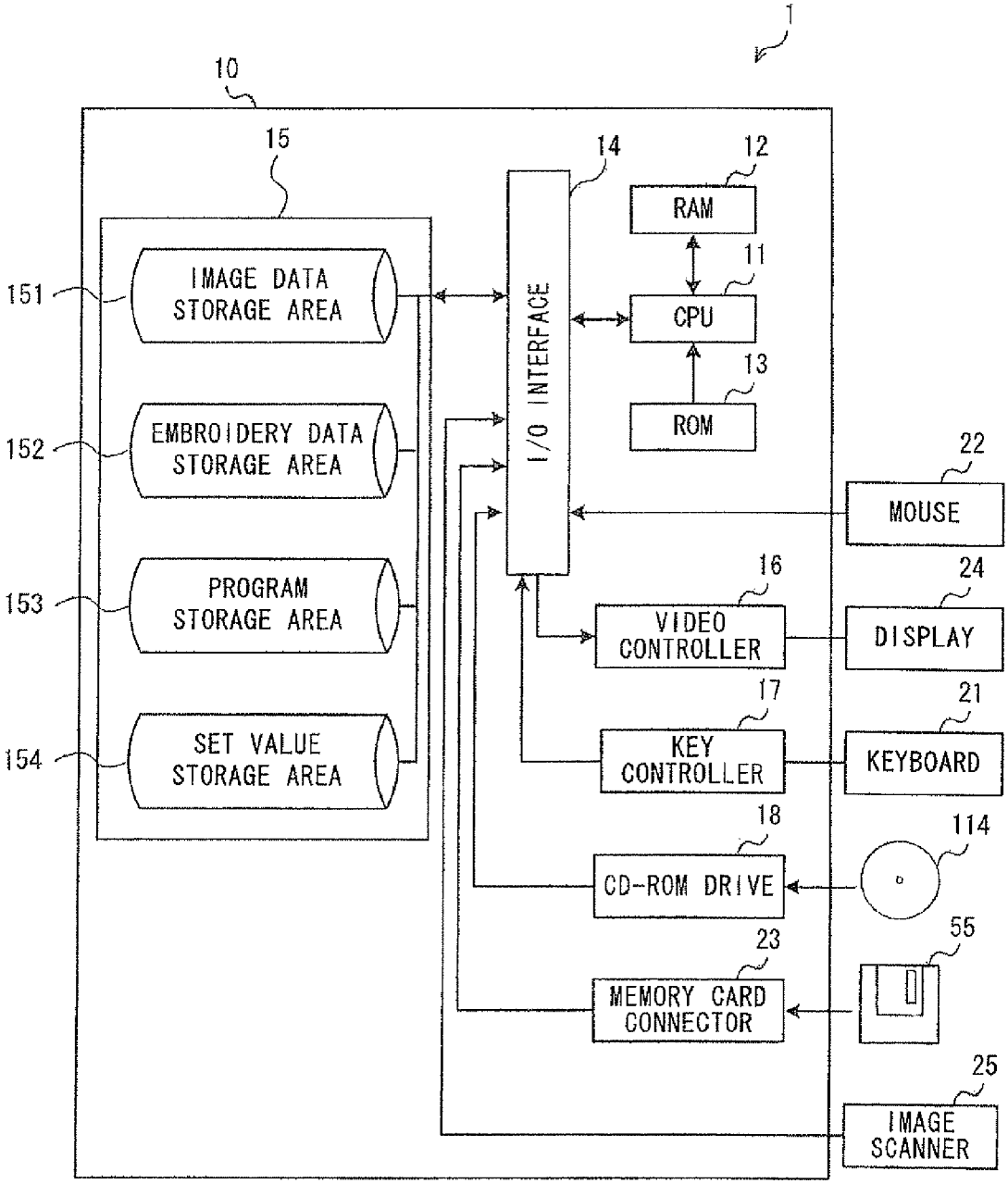
FIG. 1 is a block diagram showing an electrical configuration of an embroidery data creation device.

The embroidery data creation apparatus 1 may be a dedicated apparatus for creating embroidery data, or may be a general purpose apparatus, such as a personal computer or the like. In the present embodiment, a general purpose apparatus is shown as an example. As shown in FIG. 1, the embroidery data creation apparatus 1 includes a CPU 11, which is a controller that may perform overall control of the embroidery data creation apparatus 1. A RAM 12, a ROM 13 and an input/output (I/O) interface 14 are connected to the CPU 11. The RAM 12 may temporarily store various types of data, such as computation results obtained by computation performed by the CPU 11. The ROM 13 may store a basic input/output system (BIOS) and the like. The I/O interface 14 may relay data. A hard disk drive (HDD) 15, a mouse 22 that is an input device, a video controller 16, a key controller 17, a CD-ROM drive 18, a memory card connector 23, and an image scanner 25 are connected to the I/O interface 14. Although not shown in FIG. 1, the embroidery data creation apparatus 1 may include an external interface to connect to an external device or a network.

A display 24, which is a display device, is connected to the video controller 16 and a keyboard 21, which is an input device, is connected to the key controller 17. A CD-ROM 54 can be inserted into the CD-ROM drive 18. For example, when an embroidery data creation program is set up, the CD-ROM 54 that stores the embroidery data creation program may be inserted into the CD-ROM drive 18. Then, the embroidery data creation program may be read and stored in a program storage area 153 of the HDD 15. The embroidery data creation program may be acquired from an external device or via a network and stored in the program storage area 153. A memory card 55 can be connected to the memory card connector 23, and information of the memory card 55 can be read or information can be written into the memory card 55. In the present embodiment, image data of an image to be used as a base to create the embroidery data may be read into the embroidery data creation apparatus 1 via the image scanner 25, for example.

Storage areas of the HDD 15 will be explained. As shown in FIG. 1, the HDD 15 has a plurality of storage areas. The plurality of storage areas may include, for example, an image data storage area 151, an embroidery data storage area 152, the program storage area 153 and a set value storage area 154. The image data storage area 151 may store image data of various types of images, such as an image to be used as a base to create the embroidery data. The embroidery data storage area 152 may store embroidery data that is created by embroidery data creation processing of the present embodiment. The program storage area 153 may store programs for various types of processing performed by the embroidery data creation apparatus 1, such as the embroidery data creation program to be described later. The set value storage area 154 may store various types of set values that are used in the various types of processing. In the present embodiment, information relating to set angle characteristics may be stored as one of the set values.

Figure 2:
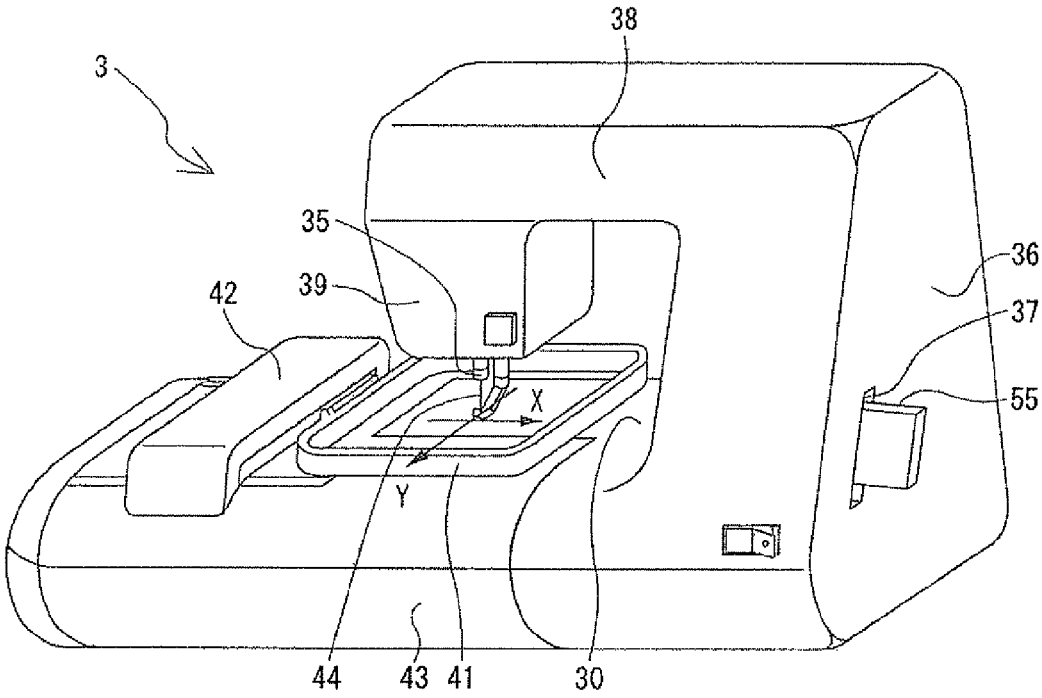
FIG. 2 is an external view of a sewing machine.

The sewing machine 3 will be briefly explained with reference to FIG. 2. The sewing machine 3 is a sewing machine that is capable of sewing an embroidery pattern based on the embroidery data created by the embroidery data creation apparatus 1. As shown in FIG. 2, the sewing machine 3 includes a bed portion 30, a pillar 36, an arm portion 38 and a head portion 39. The bed portion 30 is a base of the sewing machine 3 and extends in the left-right direction, which is the longitudinal direction. The pillar 36 extends upward from the right end of the bed portion 30. The arm portion 38 extends to the left from the upper end of the pillar 36 such that the arm portion 38 faces the bed portion 30. The head portion 39 is a portion that is connected to the left end of the arm portion 38.

An embroidery frame 41, which is configured to hold a work cloth to be embroidered, can be disposed above the bed portion 30. When embroidery sewing is performed, the embroidery frame 41 may be moved to a needle drop point by a Y direction drive portion 42 and an X direction drive mechanism (not shown in the drawings). The needle drop point is indicated by an X-Y coordinate system that is unique to the sewing machine 3. The Y direction drive portion 42 may be disposed above the bed portion 30. The X direction drive mechanism is housed in a body case 43. A needle bar 35 on which a sewing needle 44 is mounted and a shuttle mechanism (not shown in the drawings) may be driven in accordance with the movement of the embroidery frame 41, and thus an embroidery pattern may be formed on the work cloth. The Y direction drive portion 42, the X direction drive mechanism, the needle bar 35 and the like may be controlled, based on the embroidery data, by a control device (not shown in the drawings) that includes a microcomputer etc. built in the sewing machine 3.

A memory card slot 37 is provided in a side surface of the pillar 36 of the sewing machine 3. The memory card 55 can be inserted into and removed from the memory card slot 37. For example, the embroidery data created by the embroidery data creation apparatus 1 may be stored in the memory card 55 via the memory card connector 23. After that, the memory card 55 may be inserted into the memory card slot 37 of the sewing machine 3, and the stored embroidery data may be read out and stored in the sewing machine 3. The control device (not shown in the drawings) of the sewing machine 3 may control sewing operations of an embroidery pattern performed by the sewing machine 3, based on the embroidery data read out from the memory card 55. The sewing machine 3 can thus sew the embroidery pattern based on the embroidery data created by the embroidery data creation apparatus 1.

Figure 3:
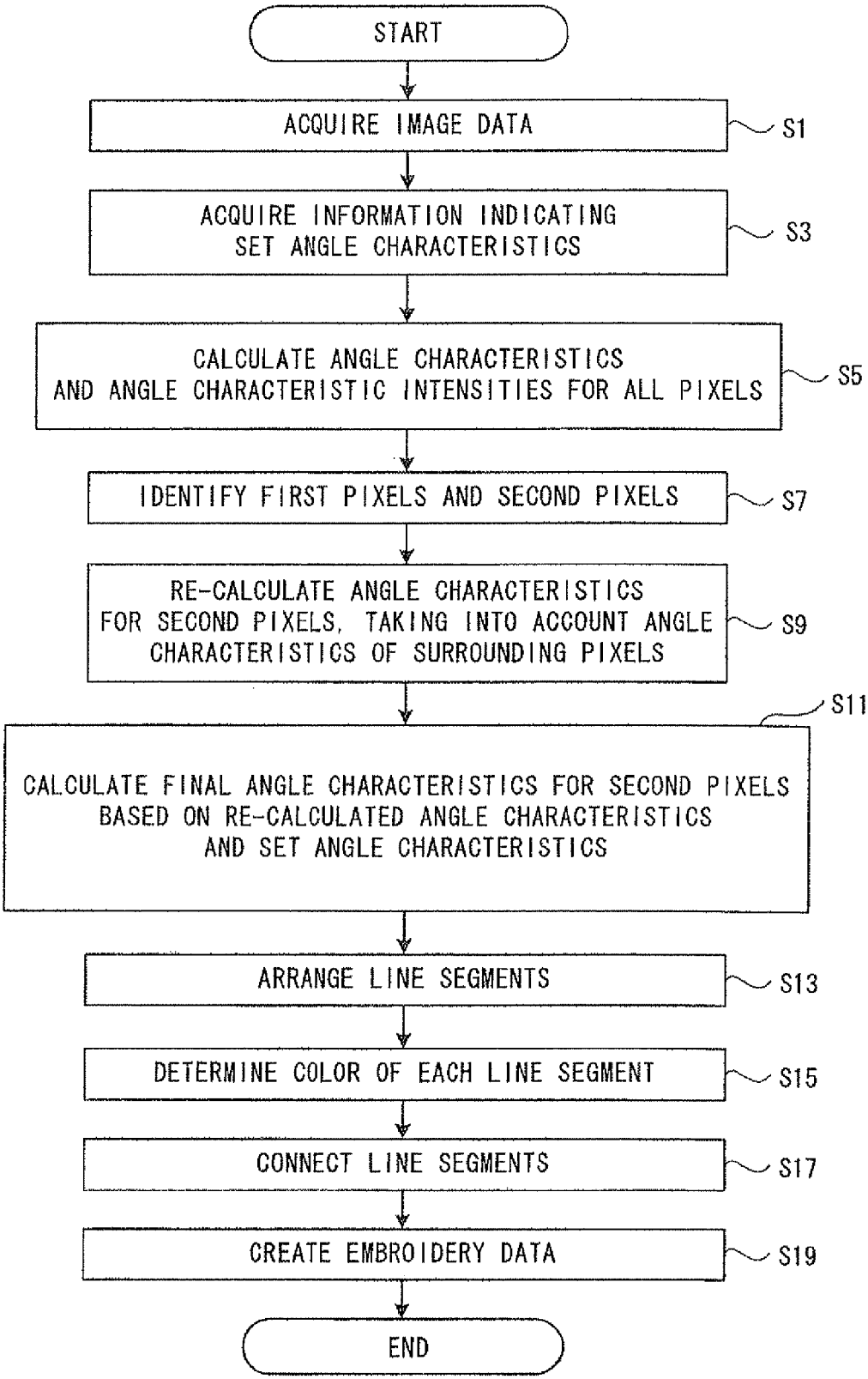
FIG. 3 is a flowchart of embroidery data creation processing according to an embodiment.

The embroidery data creation processing that is performed by the embroidery data creation apparatus 1 of the present embodiment will be explained with reference to FIG. 3 to FIG. 11. The embroidery data creation processing shown in FIG. 3 is started when the user inputs a command to start the processing. The CPU 11 activates the embroidery data creation program stored in the program storage area 153 of the HDD 15, and performs the following processing by executing computer-readable instructions included in the program.

Figure 4:
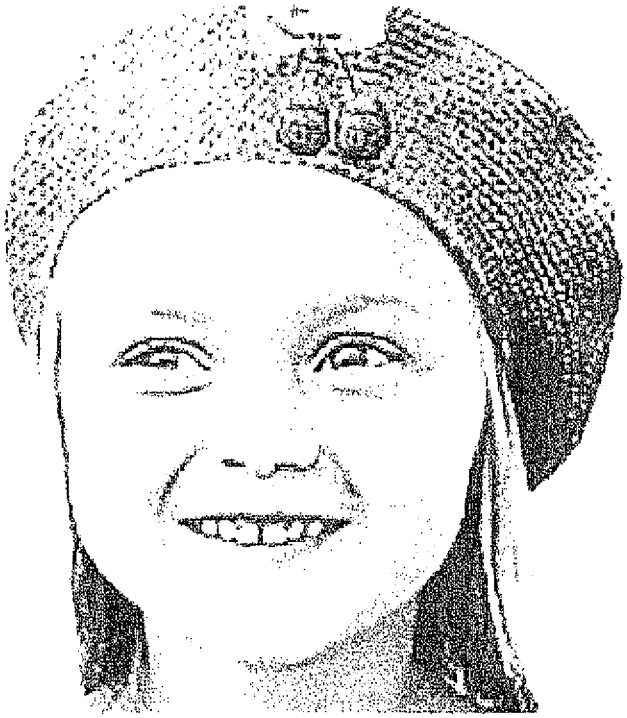
FIG. 4 is a diagram showing an example of an original image to create embroidery data.

As shown in FIG. 3, first, the CPU 11 acquires image data of an image (hereinafter referred to as an original image) that has been input into the embroidery data creation apparatus 1 and that is to be used as a base to create the embroidery data (step S1). A method for acquiring the image data is not particularly limited. For example, the CPU 11 may acquire image data of a photograph or a design that is read by the image scanner 25. Alternatively, the CPU 11 may acquire image data that is stored in advance in the image data storage area 151 of the HDD 15, or image data that is stored in an external storage medium, such as a CD-ROM 114, the memory card 55, a CD-R or the like. Note that, hereinafter, an explanation will be given using an example in which image data of a photograph shown in FIG. 4 is acquired at step S1 and the embroidery data is created based on the image data.

The CPU 11 acquires information indicating set angle characteristics (step S3) Each of the set angle characteristics is set in advance as an angle characteristic to be taken into account with respect to a pixel whose intensity is less than a predetermined threshold value, and stored in the set value storage area 154 of the HDD 15. The angle characteristic is information that indicates a direction in which continuity of a color in an image is high. In other words, the angle characteristic is information that indicates a direction in which (an angle at which) a color of a pixel shows more continuity, when the color of the pixel is compared with colors of other pixels around the pixel. The angle characteristic intensity is information that indicates a magnitude of a color change. Therefore, a pixel (hereinafter referred to as a first pixel) having an angle characteristic intensity that is equal to or more than a predetermined threshold value corresponds to a distinctive section of the image. On the other hand, a pixel (hereinafter referred to as a second pixel) having an angle characteristic intensity that is less than the predetermined threshold value corresponds to a section in which the features are weak.

In the known embroidery data creation method, line segments that correspond to stitches are arranged based on the angle characteristics and the angle characteristic intensities, and thus the embroidery data is created. More specifically, line segments centered on the first pixels that form a distinctive section are arranged first, by priority, and line segments centered on the second pixels are arranged thereafter. Note that each of the line segments centered on the second pixels is arranged in the following manner. Firstly, the line segment is arranged only for the second pixel that does not overlap with already arranged line segments. Secondly, the angle characteristic of the second pixel is re-calculated, taking into account angle characteristics of pixels (hereinafter referred to as surrounding pixels) around the second pixel. Then the line segment is arranged based on the re-calculated angle characteristic. This means that the direction of the stitch in the section with weak features is corrected to a direction that is closer to the direction of surrounding stitches. With this method, the stitches in the section with weak features can fit in well with the surrounding stitches, and it is thus possible to effectively express the distinctive section of the original image.

However, a great appeal of embroidery may be that it is possible to produce various textures utilizing the directions of stitches. For example, in a case where the photograph shown in FIG. 4 is the original image, there is almost no color change in a background section behind the girl. Therefore, with the above-described known method, stitches that are not distinctive are formed in the background section. On the contrary, if a repetitive pattern of stitches in predetermined directions is applied to this type of section, for example, the stitches in the background section can exhibit appealing qualities unique to embroidery, while the stitches in the head portion of the girl, which is a distinctive section in the image, can naturally express the original image. For this reason, in the present embodiment, the set angle characteristics are used in order to add a unique embroidered texture to the section with weak features.

Information that indicates the set angle characteristics will be explained in more detail with reference to FIG. 5 to FIG. 8. In the present embodiment, information indicating various types of set angle characteristics is stored in the set value storage area 154 of the HDD 15. Examples of the repetitive pattern of the stitches in the predetermined directions include a concentric circular stitching pattern shown in FIG. 5, a sine wave stitching pattern shown in FIG. 6 and a checkerboard stitching pattern shown in FIG. 7. In a case where these patterns are employed, the angle characteristics that indicate stitching directions of these patterns may be calculated in advance, respectively, and information indicating the set angle characteristics may be created.

Specifically, first, the CPU 11 calculates an angle characteristic corresponding to each of the pixels that form the image of each of the patterns. The CPU 11 sets a matrix having the same size as the image, and sets angle characteristics calculated for corresponding pixels to elements of the matrix, respectively. Thus, the CPU 11 can create the matrix that indicates the set angle characteristics for each of the patterns. In a case of the concentric circular stitching pattern shown in FIG. 5, a matrix such as that shown in FIG. 8 may be created. In the matrix shown in FIG. 8, angle characteristics that indicate directions of the stitches that form the concentric circles are set for the respective elements, centered on the element in the fifth row and sixth column, which is indicated by diagonal shading. Note that, centered on each of the pixels, each angle characteristic is represented by an angle that is defined when the rightward direction in the image is set as 0 degrees, the downward direction is set as 90 degrees and the leftward direction is set as 180 degrees. FIG. 8 shows the matrix with 10 rows and 10 columns in order to simplify the drawing. However, actually, the matrix of the same size as the image, namely, the matrix that includes elements corresponding to all the pixels is used. In a similar manner, the matrix that indicates the set angle characteristics can be created for the sine wave stitching pattern shown in FIG. 6 and for the checkerboard stitching pattern shown in FIG. 7.

Figure 5:
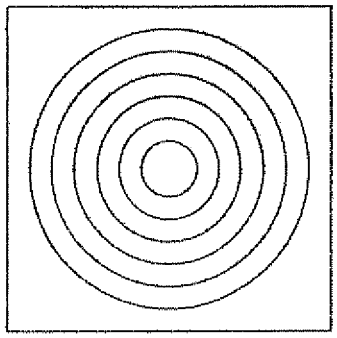
FIG. 5 is an explanatory diagram of a concentric circular stitching pattern.
Figure 6:
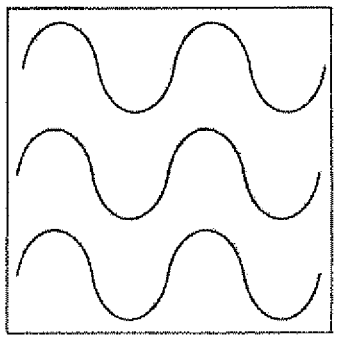
FIG. 6 is an explanatory diagram of a sine wave stitching pattern.
Figure 7:
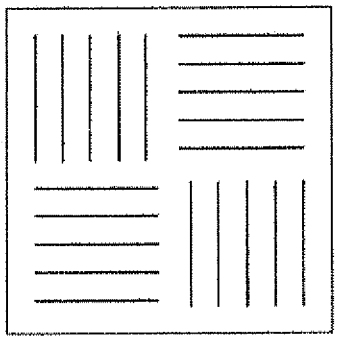
FIG. 7 is an explanatory diagram of a checkerboard stitching pattern.

In a case where a plurality of types of matrices that correspond to a plurality of stitching patterns are stored in advance in the set value storage area 154 in this manner, at step S3 of the embroidery data creation processing shown in FIG. 3, the images of the stitching patterns, such as those shown in FIG. 5 to FIG. 7, that correspond to the stored matrices may be displayed on the display 24 in a selectable manner. The user may specify a desired one of the stitching patterns by operating the mouse 22 or the keyboard 21. The CPU 11 may then acquire a matrix that corresponds to the specified stitching pattern from the set value storage area 154, and store the acquired matrix in the RAM 12.

After the information (the matrix in the present embodiment) indicating the set angle characteristics has been acquired, the CPU 11 calculates the angle characteristic and the angle characteristic intensity for each of all the pixels that form the original image (step S5). The angle characteristic and the angle characteristic intensity may be calculated using any method. The angle characteristic and the angle characteristic intensity can be calculated using a method that is described in detail, for example, in Japanese Laid-Open Patent Publication No. 2001-259268, the relevant portion of which is incorporated herein by reference. Therefore, a detailed explanation will be omitted here and only an outline will be explained. First, the CPU 11 sets, as a target pixel, one of the plurality of pixels that form the original image and sets, as a target region, the target pixel and a predetermined number of (eight, for example) pixels around the target pixel. Based on an attribute value (a luminance value, for example) relating to a color of each of the pixels in the target region, the CPU 11 identifies a direction in which the continuity of the color in the target region is high, and sets the identified direction as the angle characteristic of the target pixel. The angle characteristic is represented by an angle that is defined when the target pixel is set as the center, the rightward direction in the image is set to 0 degrees, the downward direction is set to 90 degrees and the leftward direction is set to 180 degrees. Further, the CPU 11 calculates a value indicating the magnitude of color change in the target region, and sets the calculated value as the angle characteristic intensity of the target pixel.

The CPU 11 sequentially performs the processing that calculates the angle characteristic and the angle characteristic intensity in this manner, for all the pixels that form the original image. The CPU 11 stores data indicating the angle characteristics and the angle characteristic intensities of the respective pixels in a predetermined storage area of the RAM 12. The CPU 11 may perform the same processing taking a plurality of pixels as target pixels, rather than taking one pixel as a target pixel. The CPU 11 may calculate the angle characteristic and the angle characteristic intensity using a Prewitt operator or a Sobel operator, instead of using the method described above.

Based on the calculated angle characteristic intensity, the CPU 11 identifies each of the pixels that form the original image as either the first pixel or the second pixel. The CPU 11 stores, in the RAM 12, information that indicates that each of the pixels is either the first pixel or the second pixel (step S7). Specifically, the CPU 11 identifies, among the pixels that form the original image, a pixel whose angle characteristic intensity is equal to or more than a predetermined threshold value as the first pixel. The CPU 11 identifies, as the second pixel, a pixel whose angle characteristic intensity is less than the predetermined threshold value. The threshold value that is used at step S7 may be a fixed value that is set in advance and stored in the set value storage area 154 of the HDD 15. The threshold value may also be a value that is determined by the CPU 11 based on the angle characteristic intensities of all the pixels that are calculated at step S5. Alternatively, the user may look at the angle characteristic intensities of all the pixels calculated at step S5 and input a value, which may be used as the threshold value.

The CPU 11 re-calculates the angle characteristic, taking into account the angle characteristics of the surrounding pixels, for each of the pixels identified at step S7 as the second pixels, and stores the re-calculated angle characteristic in the RAM 12 (step S9). As the re-calculation method, the method can be used that is described in detail, for example, in Japanese Laid-Open Patent Publication No. 2001-259268, the relevant portion of which is incorporated herein by reference. Therefore, a detailed explanation will be omitted here and only an outline will be explained.

First, the CPU 11 sets one of the second pixels as a target pixel, and sequentially scans the surrounding pixels (for example, eight pixels adjacent to the target pixel when a single pixel is set as the target pixel). In a case where at least one identified first pixel is included in the surrounding pixels, the CPU 11 calculates Sum1 and Sum2. The identified first pixel is the first pixel whose angle characteristic intensity is equal to or more than the threshold value. Sum1 is a sum of products of a cosine value of the angle characteristic and the angle characteristic intensity of the at least one identified first pixel. Sum 2 is a sum of products of a sine value of the angle characteristic and the angle characteristic intensity of the at least one identified first pixel. The CPU 11 calculates an arctangent value ($\tan^{-1}$ (Sum2/Sum1)) of the value (Sum2/Sum1) obtained by dividing Sum2 by Sum1. The CPU 11 sets the arctangent value as a new angle characteristic of the second pixel set as the target pixel. In this manner, the CPU 11 sequentially re-calculates the angle characteristics of the second pixels. When the angle characteristic of the second pixel is re-calculated, if the angle characteristic of the second pixel that has already been re-calculated exists among the surrounding pixels, the CPU 11 uses the re-calculated angle characteristic of the second pixel to perform the calculation, in the same manner as the angle characteristic of the first pixel. In a case where the surrounding pixels include neither the first pixel nor the second pixel for which the re-calculation has been performed, the CPU 11 sets the original angle characteristic, as it is, as the re-calculated angle characteristic of the second pixel.

The CPU 11 calculates, for each of the second pixels, a final angle characteristic to determine an arrangement direction of the line segment, based on the angle characteristic re-calculated at step S9 and on the set angle characteristic indicated by the information acquired at step S3. The CPU 11 stores the calculated final angle characteristic in the RAM 12 (step S11). The CPU 11 calculates the final angle characteristic of each of the second pixels using the following method, for example. The angle characteristic intensity of a processing target second pixel is defined as S. The threshold value for the angle characteristic intensity used at step S7 to distinguish between the first pixel and the second pixel is defined as T. The angle characteristic of the processing target second pixel that has been re-calculated using the known method at step S9 is defined as θ1. The set angle characteristic indicated by the element that corresponds to the processing target second pixel in the matrix acquired at step S3 is defined as θ2. The final angle characteristic of the second pixel is defined as θ3. The CPU 11 uses these values to respectively calculate dX and dY based on the following two formulas.

$$dX=\cos\theta 1\times S+\cos\theta 2\times(T-1-S)$$

$$dY=\sin\theta 1\times S+\sin\theta 2\times(T-1-S)$$

The CPU 11 calculates an arctangent value of the value (dY/dX) obtained by dividing dY by dX, as the final angle characteristic θ3 of the second pixel, as shown by the following formula.

$$\theta 3=\tan^{-1}(dY/dX)$$

Note that, in the above-described formulas, cos θ1 (sin θ1) is multiplied by the angle characteristic intensity S of the second pixel, as it is. On the other hand, cos θ2 (sin θ2) is multiplied by the value obtained by subtracting 1 and the angle characteristic intensity S of the second pixel from the threshold value T. This is because, since the second pixel corresponds to the section with weak features, a greater weight is added to θ1, which has been calculated using the angle characteristic(s) of the first pixel(s) in the surrounding pixels, than to the set angle characteristic θ2. Consequently, the angle characteristic of the second pixel with a stronger angle characteristic among the second pixels becomes closer to θ1, which has been calculated using the angle characteristic(s) of the first pixel(s) in the surrounding pixels. In contrast, the angle characteristic of the second pixel with a weaker angle characteristic among the second pixels becomes closer to the set angle characteristic θ2. In other words, the angle characteristic of the second pixel located close to a distinctive section is corrected to be closer to the direction of the surrounding stitches, as in the known art. On the other hand, the angle characteristic of the second pixel around which there is almost no distinctive section is corrected to be closer to the pre-set stitching direction of the stitching pattern.

The method for calculating the final angle characteristic of each of the second pixels explained above is merely an example, and another method may be used for the calculation. For example, the CPU 11 may respectively calculate dX and dY using the following formulas and may calculate θ3. Note that α is a fixed value that is larger than 0 and smaller than 1, and is applied in common to all the pixels.

$$dX=\cos\theta 1\times\alpha+\cos\theta 2\times(1-\alpha)$$

$$dY=\sin\theta 1\times\alpha+\sin\theta 2\times(1-\alpha)$$

In this case, neither dX nor dY depends on the angle characteristic intensity of the second pixel. The closer the value of α is to 1, the closer the value of θ3 is to θ1. The closer the value of α is to 0, the closer the value of θ3 is to θ2. Therefore, by appropriately setting the value of α, the user can specify the degree of the influence of the set angle characteristic θ2 as desired.

The CPU 11 may also calculate dX and dY, respectively, using the following formulas and may calculate θ3, $$dX=\cos\theta 1\times S\times\alpha+\cos\theta 2\times(T-1-S)\times(1-+)$$

$$dY=\sin\theta 1\times S\times\alpha+\sin\theta 2\times(T-1-S)\times(1-\alpha)$$

In this case, dX and dY depend on the angle characteristic intensity of the second pixel. However, by appropriately setting the value of α, the user can specify the degree of the influence of the set angle characteristic θ2.

After calculating the final angle characteristic of the second pixel, the CPU 11 performs processing that arranges line segments that respectively correspond to the stitches of the embroidery pattern (step S13). The processing that arranges the line segments may be performed using any known method. For example, the method can be used that is described in detail in Japanese Laid-Open Patent Publication No. 2001-259268, the relevant portion of which is incorporated herein by reference. With this method, line segments that do not overlap with each other as much as possible are arranged to fill the entire image as fully as possible. Hereinafter, only an outline will be explained. First, the CPU 11 sequentially arranges line segments with respect to the first pixels identified at step S7 while scanning the pixels forming the image from the left to the right and from the top to the bottom. Specifically, centered on each of the first pixels, the CPU 11 arranges a line segment which has a predetermined length (a length set in advance or a length input by the user) and which extends in the direction indicated by the angle characteristic calculated at step S5. That is, the CPU 11 arranges the line segment that directly expresses the feature in the image. The CPU 11 stores, in the RAM 12, information (coordinates) that indicates endpoints of each of the line segments.

When the line segment arrangement is complete for all the first pixels, the CPU 11 sequentially arranges line segments with respect to the second pixels that do not overlap with the line segments that correspond to the first pixels, among the second pixels identified at step S7, while scanning the pixels forming the image from the left to the right and from the top to the bottom. If any line segment that corresponds to another second pixel has already been created, the CPU 11 only arranges the line segment with respect to the second pixel that does not overlap with the already created line segment either. The line segment that corresponds to the second pixel is a line segment which has a predetermined length centered on the second pixel and which extends in the direction indicated by the angle characteristic calculated at step S11. That is, with respect to each of the second pixels, in accordance with the angle characteristic intensity of the second pixel, the CPU 11 arranges the line segment that extends in the direction that is a combination of the stitching direction of the stitching pattern selected from among the stitching patterns (refer to FIG. 5 to FIG. 7) set in advance and the arrangement direction(s) of the line segment(s) that correspond to the first pixel(s) in the surroundings. The CPU 11 stores information (coordinates) that indicates the endpoints of each of the line segments in the RAM 12.

After arranging the line segments corresponding to the first pixels and the second pixels, the CPU 11 performs processing that determines the color of each of the line segments (step S15), processing that connects the line segments of the same color (step S17), and processing that creates embroidery data that is usable in the sewing machine 3 (refer to FIG. 2) from the data of the line segments (step S19). The CPU 11 then ends the embroidery data creation processing shown in FIG. 3. The processing at step S15, step S17 and step S19 may be performed using any known method. For example, the method can be used that is described in detail in Japanese Laid-Open Patent Publication No. 2001-259268, the relevant portion of which is incorporated herein by reference. Therefore, a detailed explanation will be omitted here and only an outline will be explained below.

In the processing that determines the color of each of the line segments (step S15), the CPU 11 sets a predetermined range centered on the target pixel in the original image, as a range (a reference region) in which the color of the original image are referred to. The CPU 11 determines the color of the line segment that corresponds to the target pixel so that an average value of the colors in the reference region of the original image is equal to an average value of the colors that have already been determined for the line segments arranged in a corresponding region. The corresponding region is a region having the same size as the reference region centered on the target pixel. That is, the CPU 11 sequentially determines a color of each of the line segments based on the colors of the original image and the already determined colors of the line segments. Based on the determined color of the line segment, the CPU 11 determines a color of a thread (a thread color) to be used to sew a stitch that corresponds to the line segment. For example, the CPU 11 may determine the thread color that corresponds to the line segment to be a color that is closest to the determined color of the line segment, among a plurality of available thread colors that can be used for embroidery sewing. Specifically, the CPU 11 may calculate a spatial distance in an ROB space between RGB values of each of the available thread colors and ROB values of the color of the line segment, and may determine the thread color for which the spatial distance is the smallest, as the thread color corresponding to each line segment.

At the processing that sequentially connects the line segments of the same thread color (step S17), first, the CPU 11 identifies the line segment that is closest to the position that corresponds to the left end of the image, as a first line segment in an order of connection. The CPU 11 sets one of two endpoints of the identified line segment as a starting point, and sets the other endpoint as an ending point. The CPU 11 determines, as a second line segment to be connected, a line segment having an endpoint that is closest to the ending point of the first line segment, among the other line segments of the same thread color. In a similar manner, the CPU 11 sequentially connects the ending point of the already connected line segment with an endpoint of a line segment of the same thread color that is closest to the ending point. After that, the CPU 11 connects line segment groups, in which the line segments are connected for each thread color, by connecting endpoints that are close to each other. Thus, the CPU 11 connects all the line segments. The CPU 11 creates data that indicates positions (coordinates) of the endpoints of all the connected line segments, the order of connection and the thread colors.

In the processing that creates the embroidery data (step S19), the CPU 11 converts the coordinates of the endpoints of all the line segments into coordinates of the coordinate system that is unique to the sewing machine 3, and obtains data that indicates needle drop points, the order of sewing and the thread colors. In this manner, the CPU 11 creates the embroidery data. The CPU 11 stores the created embroidery data in the embroidery data storage area 152 of the HDD 15.

Figure 9:
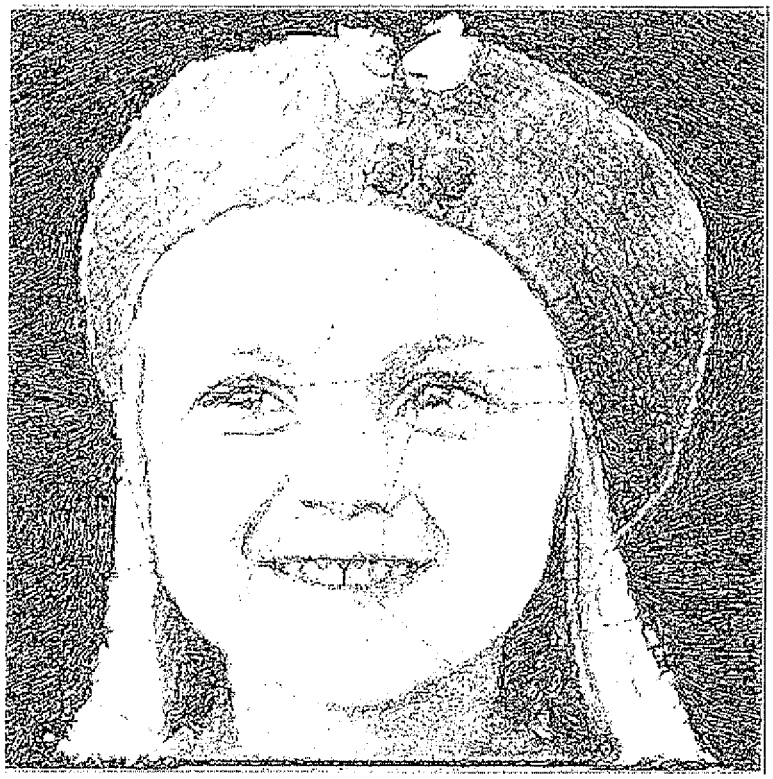
FIG. 9 is a diagram showing an example of a sewing result based on embroidery data that is created by taking into account angle characteristics of surrounding pixels only, with respect to second pixels.
Figure 10:
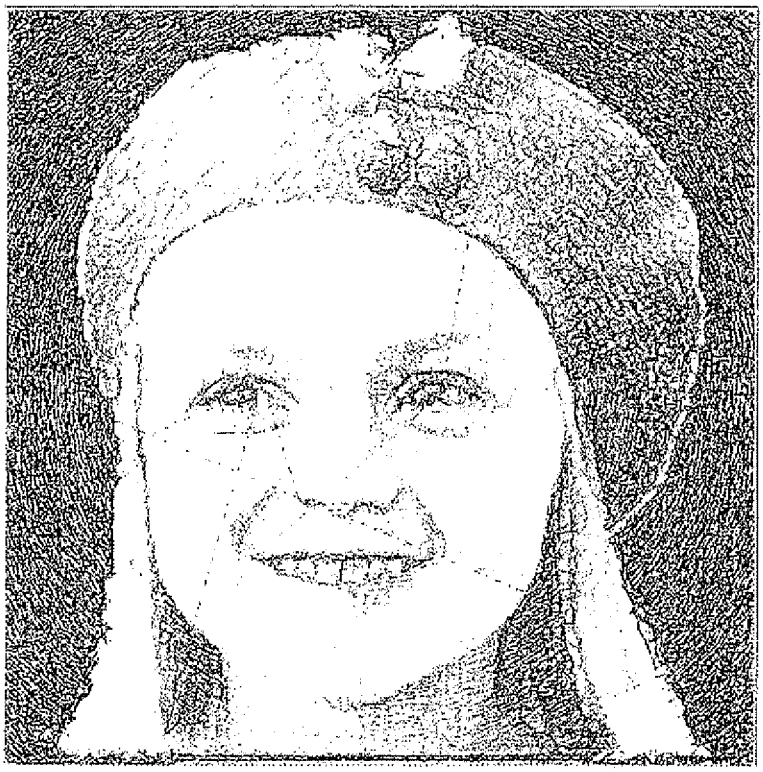
FIG. 10 is a diagram showing an example of a sewing result based on embroidery data that is created by taking into account set angle characteristics only, with respect to the second pixels.
Figure 11:
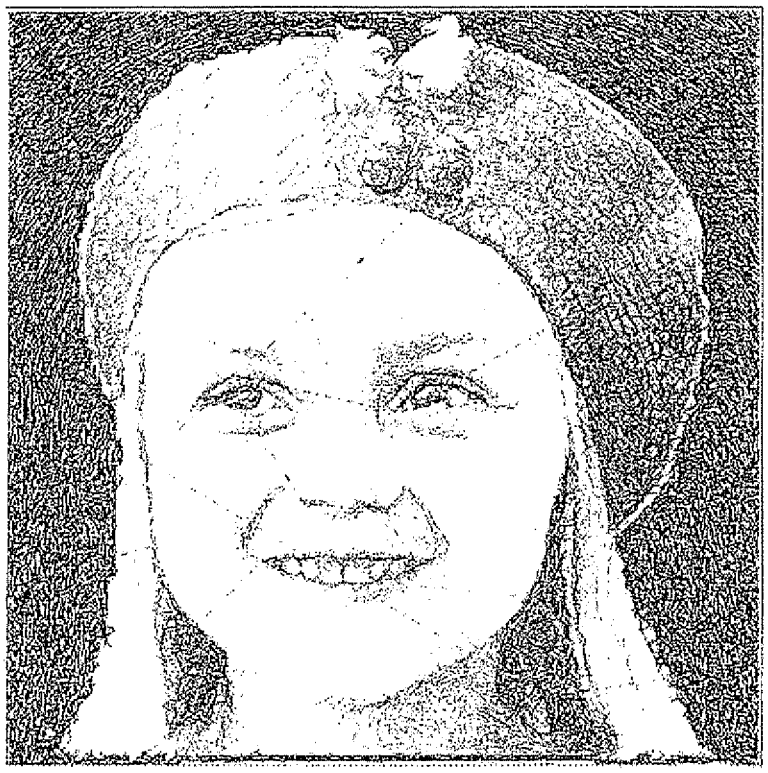
FIG. 11 is a diagram showing an example of a sewing result based on embroidery data that is created by the embroidery data creation processing according to the embodiment.

FIG. 9 to FIG. 11 each shows an example of effects when the embroidery data creation processing of the present embodiment is applied. FIG. 9 shows a result in which the line segments are arranged with respect to the second pixels of the original image shown in FIG. 4, based on only the angle characteristics re-calculated using the known method in the processing at step S9 in FIG. 3, and sewing is performed based on the created embroidery data. In this example, the entire original image is expressed by natural stitches. Particularly, when looking at a forehead region of the girl and a background region, since the features of the original image are weak in both the regions, the stitches are formed under the influence of a surrounding section with strong features, and both the regions are effectively expressed with the stitches fitting in well with the surrounding stitches. Meanwhile, particularly, in the background section, it seems that a unique embroidered texture is not sufficiently produced.

FIG. 10 shows a result in which the line segments are arranged with respect to the second pixels of the original image shown in FIG. 4 based only on the set angle characteristics set in the matrix shown in FIG. 8 that shows the concentric circular stitching pattern, and sewing is performed based on the created embroidery data. In this example, concentric circular stitches are formed in the background section and the head portion of the girl, and a unique embroidered texture can be noticeably observed. However, the concentric circular stitches tend to stand out excessively. As a result, the impression of the distinctive head portion (forehead) of the girl seems somewhat weak.

FIG. 11 shows a result in which sewing is performed based on the embroidery data that has been created by the embroidery data creation processing of the present embodiment based on the original image shown in FIG. 4. More specifically, FIG. 11 shows an example in which the line segments are arranged based on the final angle characteristics determined based on the angle characteristics re-calculated at step S9 in FIG. 3 and on the set angle characteristics of the concentric circular stitching pattern in FIG. 8. In this example, the concentric circular stitching pattern is effectively used for the section with particularly weak features. Meanwhile, in the distinctive head portion (forehead) of the girl, the concentric circular stitches do not stand out excessively and an effective expression of the original image is achieved.

As explained above, according to the embroidery data creation apparatus 1 of the present embodiment, with respect to the first pixels that correspond to the distinctive section of the original image, the line segments are arranged based on the angle characteristics calculated (step S5) based on the image data. On the other hand, with respect to the second pixels that correspond to the section with weak features, the final angle characteristics are calculated (step S 11) by taking into account the set angle characteristics set in advance, in addition to the angle characteristics that have been re-calculated (step S9) by taking into account the angle characteristics of the surrounding pixels. The line segments are then arranged based on the final angle characteristics. Then, based on the data of the arranged line segments, the embroidery data is created for the sewing machine 3 to form the stitches of the embroidery pattern.

If the angle characteristics that can produce a unique embroidered texture are set in advance as the set angle characteristics, the set angle characteristics can be reflected in the arrangement directions of the line segments that correspond to the second pixels. Therefore, as compared to a case in which only the angle characteristics of the surrounding pixels are taken into account as in the known art, it is possible to produce a unique embroidered texture by the stitches that correspond to the second pixels. Further, the angle characteristics of the surrounding pixels can also be reflected in the arrangement directions of the line segments that correspond to the second pixels. Therefore, as compared to a case in which only the set angle characteristics are taken into account, the line segments that correspond to the second pixels do not stand out excessively, and it is possible to form stitches that fit in more with the line segments that correspond to the first pixels. In other words, according to the embroidery data creation apparatus 1 of the present embodiment, it is possible to create the embroidery data that can form stitches that naturally add a unique embroidered texture while effectively expressing the features of the original image.

Further, in the present embodiment, the plurality of matrices corresponding to the plurality of types of stitching patterns (refer to FIG. 5 to FIG. 7) that can produce unique embroidered textures are stored in advance in the set value storage area 154 of the HDD 15, as the information indicating the set angle characteristics. The user can specify a desired type from among the stitching patterns as the set angle characteristics to be applied to the second pixels. Thus, the user can add a desired embroidery texture to a section with weak features.

In the embroidery data creation processing (refer to FIG. 3) of the present embodiment, after the CPU 11 re-calculates the final angle characteristics for all the second pixels at step S9 and step S11, the CPU 11 arranges the line segments at step S13. In place of this processing, the CPU 11 may re-calculate the final angle characteristics only for the second pixels for which the line segments are to be arranged. This is because, as described above, since priority is given to the first pixels in the line segment arrangement processing, the line segments may not be arranged for all the second pixels. In this case, after the processing at step S7, the CPU 11 arranges the line segments corresponding to the identified first pixels, ahead of arranging the line segments corresponding to the second pixels, using the same method as that of the above-described embodiment. After that, in the same manner as the processing at step S9 and step S11, the CPU 11 may perform the calculation processing of the final angle characteristics, only for the second pixels that do not overlap with the line segments that correspond to the first pixels and with the already arranged line segments that correspond to the second pixels, and may arrange the corresponding line segments.

The above-described embodiment can be modified in various ways. For example, the processing may be changed such that the user can set the region in which the set angle characteristics are to be taken into account with respect to the second pixels, namely, the region to which a unique embroidered texture is to be added. Hereinafter, embroidery data creation processing according to a modified example will be explained with reference to FIG. 12, FIG. 4 and FIG. 13. Hereinafter, in the embroidery data creation processing of the modified example shown in FIG. 12, processing that has the same content as the embroidery data creation processing (refer to FIG. 3) of the above-described embodiment is denoted with the same step number and an explanation thereof is simplified, and processing that is different from the processing of the above-embodiment will be explained in detail.

Figure 12:
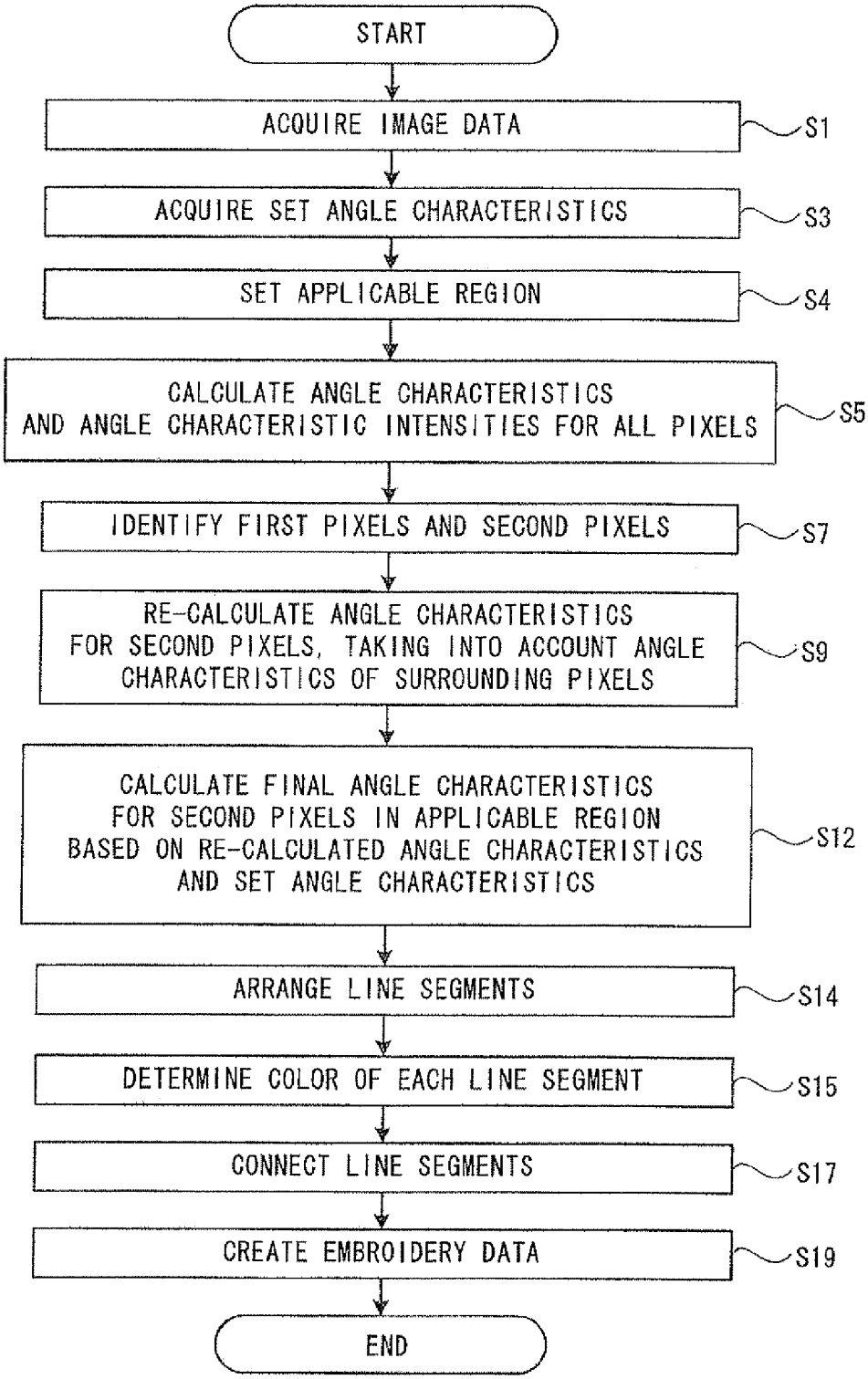
FIG. 12 is a flowchart of embroidery data creation processing according to a modified example.
Figure 13:
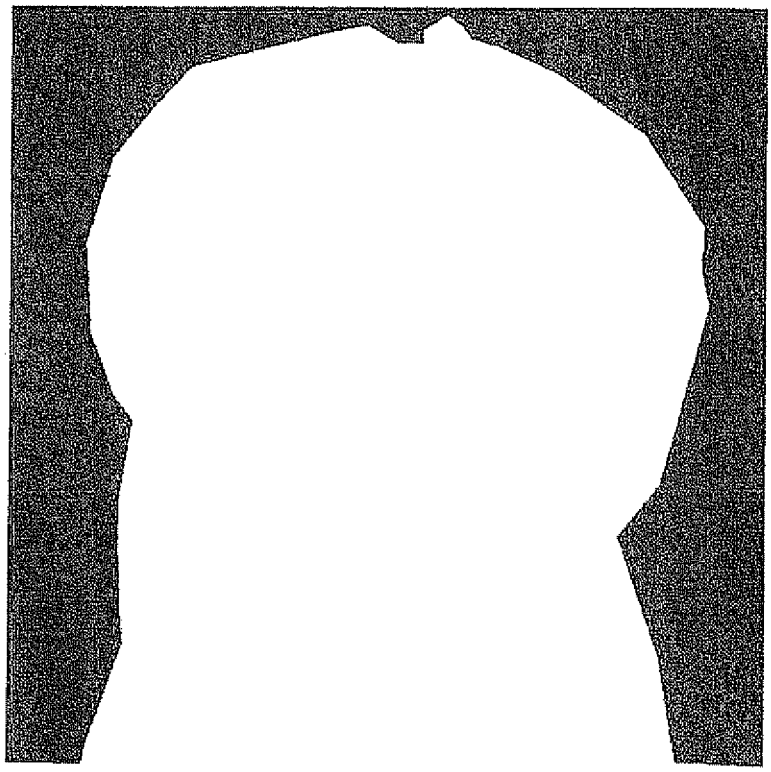
FIG. 13 is a diagram showing an example of an applied region.

As shown in FIG. 12, also in the embroidery data creation processing according to the modified example, the processing (step S1, step S3) in which the CPU 11 acquires image data of an input image and acquires information indicating the set angle characteristics is the same as in the above-described embodiment. After that, the CPU 11 performs processing that sets an applied region (step S4). The applied region is a region in which the final angle characteristics, which are calculated by taking into account the set angle characteristics, are applied to the second pixels. For example, the CPU 11 may set a region specified by the user as the applied region.

For example, first, the CPU 11 may cause the display 24 to display a region setting screen (not shown in the drawings) that includes the original image (refer to FIG. 4). The user may specify a given closed region on the region setting screen by operating the mouse 22. Specifically, for example, the user may repeat an operation of clicking the mouse 22 at a given point on the region setting screen while moving the mouse 22. When the mouse 22 is clicked again at a first point, the specifying of the closed region is complete. The CPU 11 may set the applied region by identifying positions in the image that correspond to the clicked points and sequentially connecting the identified positions by line segments.

Alternatively, the user may drag the mouse 22 freehand. The CPU 11 may set the applied region by identifying a movement trajectory of a pointer (not shown in the drawings) of the mouse 22 as a boundary line of the applied region. In a case where the movement trajectory of the pointer is not closed, the CPU 11 may set the applied region by connecting a starting point and an ending point of the movement trajectory. The CPU 11 may store information indicating the boundary line of the set applied region in the RAM 12.

For example, in a case where the user wants to add a unique embroidered texture just to the background section of the girl in the original image shown in FIG. 4, the user may use the above-described method to specify just the background section as the applied region. In this case, the black region shown in FIG. 13 may be set as the applied region.

The processing that calculates the angle characteristics and the angle characteristic intensities of all the pixels based on the image data of the original image (step S5) and the processing that identifies the first pixels and the second pixels (step S7) are the same as in the above-described embodiment. The processing that uses the known method to re-calculate the angle characteristics of the second pixels by taking into account the angle characteristics of the surrounding pixels (step S9) is the same as in the above-described embodiment.

Next, with respect to the second pixels in the applied region, the CPU 11 calculates the final angle characteristics of the second pixels in the applied region, based on the angle characteristics re-calculated at step S9 and on the set angle characteristics indicated by the information acquired at step S3 (step S12). A method for calculating the final angle characteristics is basically the same as the method explained for the processing at step S11 of the above-described embodiment. Note, however, that the processing in the modified example differs in that the second pixels to be set as targets are not the second pixels in the entire region of the original image, but only the second pixels in the applied region.

In the subsequent processing that arranges the line segments at step S14, the CPU 11 arranges the line segments that correspond to the first pixels in the same manner as the above-described embodiment. On the other hand, a method for arranging the line segments that correspond to the second pixels differs depending on whether or not the processing target second pixel is located in the applied region. First, with respect to each of the second pixels in the applied region (including the second pixels on the boundary line), the CPU 11 arranges a line segment in the same manner as the above-described embodiment. More specifically, centered on each of the second pixels, the CPU 11 arranges a line segment which has a predetermined length and which extends in the direction indicated by the angle characteristics calculated at step S12. On the other hand, with respect to each of the second pixels that are located outside the applied region, the CPU 11 applies the angle characteristic which has been re-calculated using the known method at step S9, by taking into account the angle characteristics of the surrounding pixels to the original angle characteristic of the second pixel. More specifically, centered on each of the second pixels, the CPU 11 arranges a line segment which has a predetermined length and which extends in the direction indicated by the angle characteristic calculated at step S9.

The subsequent processing that determines the color of each of the line segments (step S15), the processing that connects the line segments (step S17), and the processing that creates the embroidery data (step S19) are the same as in the above-described embodiment.

As explained above, in the embroidery data creation processing according to the modified example, the angle characteristics of the surrounding pixels and the set angle characteristics are taken into account only for the second pixels in the set applied region, and only the angle characteristics of the surrounding pixels are taken into account for the second pixels outside the applied region. Therefore, if the user specifies only a particular region (a region in which color change in the image is particularly small, such as a background behind a person, for example), it is possible to cause the embroidery data creation apparatus 1 to create the embroidery data to which a unique embroidered texture is added.

Also in this modified example, the CPU 11 need not necessarily perform the processing that arranges all the line segments collectively at step S14. Specifically, after arranging just the line segments corresponding to the first pixels identified at step S7, the CPU 11 may perform the processing at step S9 and step S12 only for the second pixels in the applied region to calculate the final angle characteristics, and thereafter arrange the line segments. Further, for the second pixels outside the applied region, the CPU 11 may re-calculate the angle characteristics by performing the processing at step S9, and thereafter perform the line segment arrangement processing.

The above-described modified example is merely an example and other modifications may be made to the above-described embodiment. For example, a plurality of types of information that can be selected (for example, the matrices of the above-described embodiment) need not necessarily be prepared as the information indicating the set angle characteristics. The CPU 11 may consistently use one type of set angle characteristic information. The information indicating the set angle characteristics need not necessarily be information relating to the repetitive pattern of the stitches in predetermined directions as exemplified in the above-described embodiment.

In the case of the repetitive pattern of the stitches in the predetermined directions, the matrix exemplified in FIG. 8 need not necessarily be prepared as the information indicating the set angle characteristics. In this case, at step S5 of the embroidery data creation processing (refer to FIG. 3), the CPU 11 may acquire only the information indicating a stitching pattern to be used, as the information indicating the set angle characteristics. Then, at step S11, the CPU 11 may calculate angle characteristics in accordance with the acquired information, and may use the calculated angle characteristics as the set angle characteristics.

Figure 14:
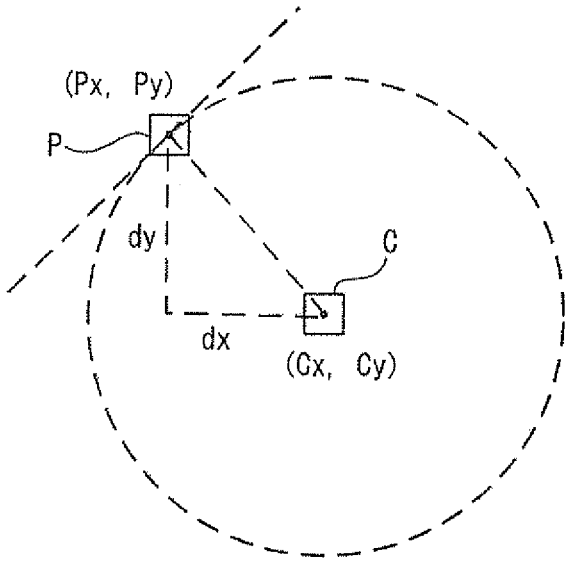
FIG. 14 is an explanatory diagram of a method for calculating the set angle characteristics.

For example, in the case of the concentric circular stitching pattern shown in FIG. 5, the CPU 11 can calculate the set angle characteristic of each of the second pixels in the following manner. As shown in FIG. 14, it is defined that a pixel located at the center of the image is a center pixel C and coordinates of the center pixel C are (Cx, Cy). It is defined that the second pixel that is used as a target to calculate the set angle characteristic is a target second pixel P, coordinates of the target second pixel P are (Px, Py), and the set angle characteristic of the target second pixel P is θ. In the case of the concentric circle, the set angle characteristic θ is the angle of a tangent line at the target second pixel P of a circle whose center is at the center pixel C and whose radius is a line segment CP. Therefore, when dx=Cx−Px and dy=Cy−Py, the set angle characteristic θ can be calculated using the following formula.

$$\theta=\tan^{-1}\{dx/(-dy)\}$$

Also in the case of another repetitive pattern, such as the sine wave (refer to FIG. 6), the checkerboard pattern (refer to FIG. 7) or the like, the matrix need not necessarily be prepared as long as a formula is set to calculate the set angle characteristics of the second pixels in relation to a pixel that serves as a reference.

Further, the information indicating the set angle characteristics may be information that indicates, for example, an angle to rotate the angle characteristics re-calculated by taking into account the angle characteristics of the surrounding pixels at step S9 of the embroidery data creation processing (refer to FIG. 3). For example, when information indicating "30 degrees in a clockwise direction" is set as the information indicating the set angle characteristic, an angle (note that, if the angle exceeds 180 degrees, 180 degrees is subtracted from the angle) obtained by adding 30 degrees to the angle characteristic (angle) calculated at step S9 is acquired at step S11 as the final angle characteristic (angle) of each of the second pixels. Further, this type of set angle characteristic may be applied to the embroidery data creation processing according to the modified example shown in FIG. 12. In this case, the line segments corresponding to the second pixels in the applied region only are rotated by the set angle, and thus stitches with a texture different from that of the other regions can be formed in the applied region.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An apparatus comprising:

a processor; and a memory configured to store computer-readable instructions that, when executed by the processor, cause the apparatus to perform steps comprising:

calculating, based on image data of an image that is an aggregation of a plurality of pixels, a first angle characteristic and an intensity of the first angle characteristic with respect to each of the plurality of pixels, wherein the first angle characteristic is information indicating a direction in which continuity of a color in the image is high, and the intensity is information indicating a magnitude of change of the color;

arranging a first line segment in a position that corresponds to a first pixel based on the calculated first angle characteristic, wherein the first pixel is a pixel whose calculated intensity is equal to or more than a threshold value, among the plurality of pixels;

calculating a second angle characteristic of a second pixel based on the first angle characteristic of at least one pixel adjacent to the second pixel, wherein the second pixel is a pixel whose calculated intensity is smaller than the threshold value, among the plurality of pixels;

acquiring information indicating a third angle characteristic, wherein the third angle characteristic is an angle characteristic set in advance;

calculating a fourth angle characteristic based on the calculated second angle characteristic and on the third angle characteristic indicated by the acquired information;

arranging a second line segment in a position that corresponds to the second pixel based on the calculated fourth angle characteristic; and creating, as embroidery data, data indicating at least stitches that respectively correspond to the arranged first line segment and the arranged second line segment.

2. The apparatus according to claim 1, wherein the computer-readable instructions further cause the apparatus to perform steps comprising:

setting an applied region in accordance with an input command, wherein the applied region is a region, within the image, in which the second line segment is to be arranged based on the fourth angle characteristic; and arranging the second line segment based on the second angle characteristic when the second pixel is outside the applied region, and wherein the calculating of the fourth angle characteristic includes calculating the fourth angle characteristic only when the second pixel is in the applied region, the arranging of the second line segment based on the fourth angle characteristic includes arranging the second line segment based on the fourth angle characteristic only when the second pixel is in the applied region, and the creating of the embroidery data includes creating data indicating stitches that respectively correspond to the first line segment arranged based on the first angle characteristic, the second line segment arranged based on the second angle characteristic, and the second line segment arranged based on the fourth angle characteristic.

3. The apparatus according to claim 1, wherein the memory is further configured to store a plurality of types of the information indicating the third angle characteristic, the computer-readable instructions further cause the apparatus to perform a step of accepting a command specifying one of the plurality of types of the information, and the acquiring of the information indicating the third angle characteristic includes acquiring the information specified by the command.

4. A non-transitory computer-readable medium storing computer-readable instructions that, when executed by a processor of an apparatus, cause the apparatus to perform steps comprising:

calculating, based on image data of an image that is an aggregation of a plurality of pixels, a first angle characteristic and an intensity of the first angle characteristic with respect to each of the plurality of pixels, wherein the first angle characteristic is information indicating a direction in which continuity of a color in the image is high, and the intensity is information indicating a magnitude of change of the color;

arranging a first line segment in a position that corresponds to a first pixel based on the calculated first angle characteristic, wherein the first pixel is a pixel whose calculated intensity is equal to or more than a threshold value, among the plurality of pixels;

calculating a second angle characteristic of a second pixel based on the first angle characteristic of at least one pixel adjacent to the second pixel, wherein the second pixel is a pixel whose calculated intensity is smaller than the threshold value, among the plurality of pixels;

acquiring information indicating a third angle characteristic, wherein the third angle characteristic is an angle characteristic set in advance;

calculating a fourth angle characteristic based on the calculated second angle characteristic and on the third angle characteristic indicated by the acquired information;

arranging a second line segment in a position that corresponds to the second pixel based on the calculated fourth angle characteristic; and creating, as embroidery data, data indicating at least stitches that respectively correspond to the arranged first line segment and the arranged second line segment.

5. The non-transitory computer-readable medium according to claim 4, wherein the computer-readable instructions further cause the apparatus to perform steps comprising:

setting an applied region in accordance with an input command, wherein the applied region is a region, within the image, in which the second line segment is to be arranged based on the fourth angle characteristic; and arranging the second line segment based on the second angle characteristic when the second pixel is outside the applied region, and wherein the calculating of the fourth angle characteristic includes calculating the fourth angle characteristic only when the second pixel is in the applied region, the arranging of the second line segment based on the fourth angle characteristic includes arranging the second line segment based on the fourth angle characteristic only when the second pixel is in the applied region, and the creating of the embroidery data includes creating data indicating stitches that respectively correspond to the first line segment arranged based on the first angle characteristic, the second line segment arranged based on the second angle characteristic, and the second line segment arranged based on the fourth angle characteristic.

6. The non-transitory computer-readable medium according to claim 4, wherein the computer-readable instructions further cause the apparatus to perform a step of accepting a command specifying one of a plurality of types of the information indicating the third angle characteristic, wherein the plurality of types of the information is stored in a memory, and the acquiring of the information indicating the third angle characteristic includes acquiring the information specified by the command.

* * * * *